United States Patent [19]

Lichtner

[11] 4,426,963

[45] Jan. 24, 1984

[54] LIGHT METAL CYLINDER HEAD FOR A VALVE-CONTROLLED INTERNAL COMBUSTION ENGINE

[75] Inventor: Emil Lichtner, Odenthal-Voiswinkel, Fed. Rep. of Germany

[73] Assignee: Klöckner-Humboldt-Deutz Aktiengesellschaft, Cologne, Fed. Rep. of Germany

[21] Appl. No.: 298,946

[22] Filed: Sep. 3, 1981

[30] Foreign Application Priority Data

Sep. 13, 1980 [DE] Fed. Rep. of Germany ..... 3034591

[51] Int. Cl.[3] ..... F02F 1/26

[52] U.S. Cl. ..... 123/193 H; 123/668

[58] Field of Search ..... 123/193 R, 193 H, 668, 123/669, 193 CH

[56] References Cited

U.S. PATENT DOCUMENTS

| | | | |
|---|---|---|---|
| 3,459,167 | 8/1969 | Briggs et al. | 123/669 |
| 3,552,370 | 1/1971 | Briggs | 123/669 |
| 3,911,891 | 10/1975 | Dowell | 123/669 |
| 4,245,611 | 1/1981 | Mitchell et al. | 123/669 |
| 4,254,621 | 3/1981 | Nagumo | 123/193 H |
| 4,337,735 | 7/1982 | Lichtner et al. | 123/193 H |

FOREIGN PATENT DOCUMENTS

| | | | |
|---|---|---|---|
| 147036 | 6/1952 | Australia | 123/669 |
| 691517 | 7/1964 | Canada | 123/668 |
| 2937216 | 4/1981 | Fed. Rep. of Germany | 123/193 CH |
| 2061383 | 5/1981 | United Kingdom | 123/668 |

*Primary Examiner*—Craig R. Feinberg

*Attorney, Agent, or Firm*—Becker & Becker, Inc.

[57] ABSTRACT

A light metal cylinder head for a valve-controlled internal combustion engine. The cylinder head is provided with at least one insert introduced into that bottom portion of the cylinder head located between the valves, and also has a bore, in that portion of the cylinder head bottom which faces the combustion chamber, for an injection nozzle or a straight channel and/or for an ignition aid, whereby at least the bottom region located between the valves, including the bore region, is coated with a crack-precluding oxide layer. In addition, that portion of the insert which comes into contact with the oxide layer is coated with a material which is resistant to the method of producing the oxide layer.

1 Claim, 2 Drawing Figures

LIGHT METAL CYLINDER HEAD FOR A VALVE-CONTROLLED INTERNAL COMBUSTION ENGINE

Figure 1:
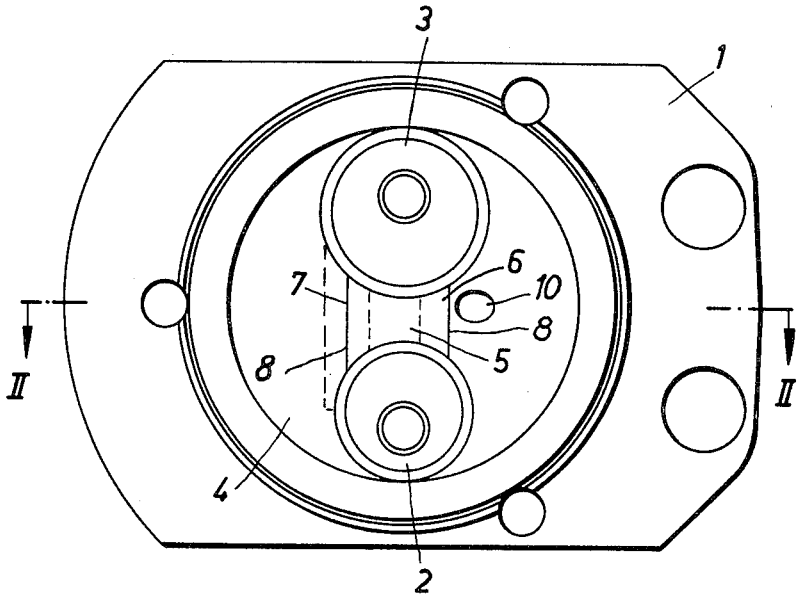

The present invention relates to a light metal or alloy cylinder head for a valve-controlled internal combustion engine. The cylinder head is provided with at least one insert inserted into that bottom portion of the cylinder head located between the valves, and also has a bore, in that portion of the cylinder head bottom which faces the combustion chamber, for an injection nozzle or a straight channel and/or an ignition aid; at least the bottom region located between the valves, including the bore region, is coated with a crack-precluding oxide layer.

Such a cylinder head is disclosed in the assignee's co-pending application Ser. No. 119,108 Lichtner et al filed Feb. 6, 1980, U.S. Pat. No. 4,337,735—Lichtner et al issued July 6, 1982, belonging to the assignee of the present invention. The inserts disclosed therein are intended to help preclude the formation of heat cracks in the bottom region between the valves.

However, with cylinder heads having a central injection nozzle or a straight channel and/or ignition aid, the web inserts cannot preclude the appearance of heat cracks in the region of the bore of the nozzle, channel, or ignition-aid, which cracks also extend to the valve seats or to the outer sealing surfaces on the cylinder bottom.

For this reason, it is furthermore proposed in the aforementioned U.S. Pat. No. 4,337,735—Lichtner et al to coat the crack-prone bottom region with a crack-precluding oxide layer. On the one hand, a reduction of temperature peaks is obtained with the oxide layer, so that an equalizing of the cylinder head bottom temperature is attained. On the other hand, the oxide layer has a different thermal expansion than does the light metal. Consequently, at operating temperatures, great tensile stresses occur in the oxide layer, so that the adjoining light metal region likewise is still subjected to tensile stress. This prevents the otherwise occurring pressure stresses, which lead to heat cracks. Furthermore, the oxide layer prevents the formation of cavities or shrinkage faults in that portion of the cylinder head bottom which faces the combustion chamber, which faults are otherwise observed after having been used for a long time.

This oxide layer, however, required that the inserts of sheet metal had to be covered during the application of the oxide layer, which was time consuming and costly. In addition, a minimum adhesive spacing of two millimeters had to be maintained, which was not possible between the bore or bores and the adjoining webs for structural reasons. Therefore, it was already proposed to make the inserts of titanium. Although this proved feasible, the price for the insert increased, so that the entire cylinder head became more expensive.

It is therefore an object of the present invention to provide cylinder head inserts which are less expensive to produce and which are also resistant with respect to the method for applying the crack-precluding oxide layer.

Figure 2:
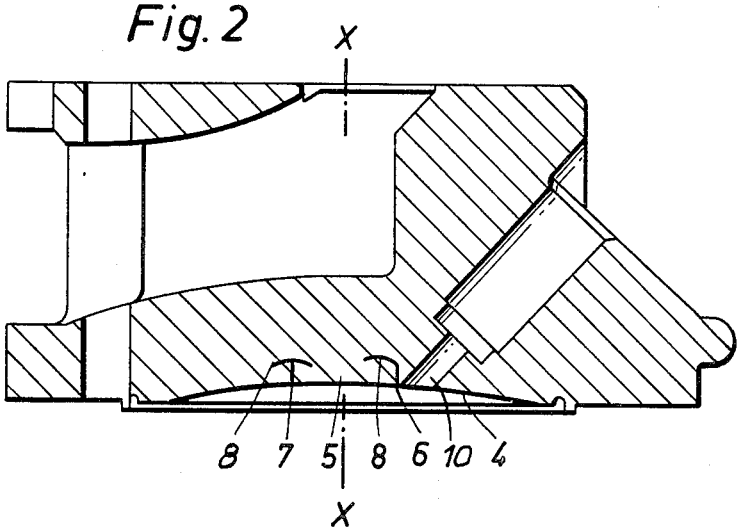

This object, and other objects and advantages of the present invention, will appear more clearly from the following specification in connection with the accompanying drawing, in which:

FIG. 1 shows a cylinder head of a valve-controlled internal combustion engine in a plan view upon the bottom of the cylinder head; and FIG. 2 is a section taken along line II—II in FIG. 1.

The cylinder head of the present invention is characterized primarily in that a particular portion of the insert which comes into contact with the oxide layer is coated with a material resistant as to the method for producing the oxide layer.

The advantage of this arrangement is that the inserts, as previously, can comprise sheet metal plates. These plates are only coated with an appropriately resistant material in that region in which they come into contact with the crack-precluding oxide layer.

An aluminum oxide layer has proven successful as a crack-precluding oxide layer, and is applied by anodic oxidation. When utilizing aluminum oxide as the crack-precluding protective layer, it is particularly suitable to coat the plate inserts with aluminum or ceramic, at least where they come into contact with the oxide layer. Methods for applying these materials to plates are known, and are also suitable for mass production. Since these materials are resistant to the crack-precluding oxide layer, the time consuming process of coating the web inserts is eliminated.

Referring now to the drawing in detail, with the cylinder head 1 illustrated in the drawing, the outlet or exhaust valve opening is designated with the reference numeral 2, the inlet or intake valve opening is designated with the reference numeral 3, and the somewhat dished or curved cylinder head bottom is designated with the reference numeral 4. That bottom region 5 located between the two valve openings 2 and 3 is thermally highly stressed and is consequently particularly prone to the development or formation of cracks. This bottom region 5 can also embrace the edge region of the bore 10 for the injection nozzle and/or ignition aid. The bottom region 5 is separated from the external bottom region by expansion joints or grooves 6 and 7 which extend from valve opening to valve opening. The expansion joints 6 and 7 are provided with web inserts 8 (plates), and can have the cross sectional shape especially shown in FIG. 2.

This embodiment has precluded the thermal cracks in the bottom region 5 between the valves, but not always those cracks in the region of the nozzle- and/or ignition-aid bore 10, nor those which originate therefrom, with the presence of a firing or straight channel, and continue to the outer sealing region between the cylinder head bottom and the cylinder tube or sleeve.

For this reason, after production, the cylinder head together with the web inserts is dipped into an acid bath, where the cylinder head is connected as the anode. When direct or alternating current of high current density is applied, a reinforced aluminum oxide layer, which becomes securely integral therewith, is formed. The cylinder head 1 remains in the acid bath for a period of time determined by the size of the surface to be coated, and the thickness of the oxide layer. The layer thickness is generally sufficient when it has grown to at least 50 $\mu$m. Depending upon the size of the cylinder head bottom, it may be expedient to cover with a mask particularly that portion of the bottom which is not part of the region prone to crack formation.

Since the web inserts 8 are made of steel, they should be attacked or corroded during the application of the oxide layer. For this reason, the upper region of the web inserts, i.e. that region which comes into contact with the crack-precluding oxide layer, is coated with a layer which is not attacked by the crack-precluding oxide layer. An aluminum or ceramic coating is suitable for this purpose, and is applied to the web inserts before they are, embedded or cast in the cylinder head bottom.

The present invention is, of course, in no way restricted to the specific disclosure of the specification and drawing, but also encompasses any modifications within the scope of the appended claims.

What is claimed is:

1. An improvement in an aluminum alloy cylinder head for a valve-controlled internal combustion engine, said cylinder head having a bottom surface which faces into an associated combustion chamber, the bottom surface having a pair of spaced valve openings therethrough defining an area therebetween on the bottom surface which is subject to crack propogation, said cylinder head also having a bore disposed through the area for receiving one of the group consisting of an ignition related device and an injection-related device, the improvement comprising:

a pair of substantially parallel, spaced, stress relief grooves in said area, the grooves extending longitudinally between the valve openings and having surfaces;

a pair of spaced steel inserts embedded in the cylinder head and extending longitudinally between the valve openings while extending laterally across the bottom of the grooves, each insert having a surface exposed in the grooves;

a coating of material which is resistant to oxidation overlying the surfaces of the steel inserts which are exposed in the grooves, the coating being of a material selected from the group consisting of ceramic material and aluminum material, and a crack-precluding aluminum oxide layer formed by anodic oxidation at a high current density on the bottom surface of the cylinder head and covering at least the area between said valve openings and the surfaces of the grooves, the oxide layer being precluded from contact with the steel inserts during formation of the layer due to protection of the inserts by the coatings.

* * * * *